US009221185B2

(12) United States Patent
Walker, Jr. et al.

(10) Patent No.: US 9,221,185 B2
(45) Date of Patent: Dec. 29, 2015

(54) SHAVING RAZORS AND CARTRIDGES

(75) Inventors: Vincent Paul Walker, Jr., Bridgewater, MA (US); Kevin James Wain, Reading (GB); Alejandro Carlos Lee, Cambridge, MA (US); Edward Neill Forsdike, Reading (GB); Matthew Corey Cataudella, South Boston, MA (US)

(73) Assignee: The Gillette Company, Boston, MA (US)

( * ) Notice: Subject to any disclaimer, the term of this patent is extended or adjusted under 35 U.S.C. 154(b) by 739 days.

(21) Appl. No.: 12/552,310

(22) Filed: Sep. 2, 2009

(65) Prior Publication Data

US 2010/0058595 A1 Mar. 11, 2010

Related U.S. Application Data

(60) Provisional application No. 61/095,840, filed on Sep. 10, 2008.

(51) Int. Cl.

| | |
|---|---|
| ***B26B 21/14*** | (2006.01) |
| ***B26B 21/00*** | (2006.01) |
| ***B26B 21/40*** | (2006.01) |

(Continued)

(52) U.S. Cl.

CPC ..... *B26B 21/4012* (2013.01); *B26B 21/225* (2013.01); *B26B 21/4018* (2013.01); *B26B 21/4031* (2013.01); *B26B 21/521* (2013.01)

(58) Field of Classification Search

CPC ..... B26B 21/4012; B26B 21/4018; B26B 21/4025; B26B 21/4031; B26B 21/225; B26B 21/521

USPC ..... 30/50, 34.2, 77, 81, 82

IPC ..... B26B 21/4012,21/4018, 21/4025, 21/4031

See application file for complete search history.

(56) References Cited

U.S. PATENT DOCUMENTS

| | | | |
|---|---|---|---|
| 1,474,471 | A | 11/1923 | Greenbrier |
| 4,044,463 | A | 8/1977 | Tietjens |

(Continued)

FOREIGN PATENT DOCUMENTS

| | | | |
|---|---|---|---|
| EP | 0 254 491 | A1 | 1/1988 |
| EP | 0 314 266 | A1 | 5/1989 |

(Continued)

OTHER PUBLICATIONS

PCT International Search Report with Written Opinion in corresponding Int'l appln. PCT/US2009/056189 dated Jan. 1, 2010.

*Primary Examiner* — Clark F Dexter

(74) *Attorney, Agent, or Firm* — John M. Lipchitz; Kevin C. Johnson; Steven W. Miller

(57) ABSTRACT

A shaving razor with a handle and a housing mounted to the handle. The housing has a proximal end portion, a distal end portion, and at least one blade having a cutting edge. The blade is mounted to the housing with a blade support structure. A guard is at the distal end portion of the housing and has a plurality of projections substantially perpendicular to the blade that define a plurality of slots. A washout cavity beneath the blade is defined by an inner surface of the guard and an inner surface of the blade support structure. The washout cavity has an open area of at least 80 percent for allowing unobstructed passage of water substantially along an entire length of the blade.

10 Claims, 7 Drawing Sheets

(51) Int. Cl.

| | |
|---|---|
| ***B26B 21/22*** | (2006.01) |
| ***B26B 21/52*** | (2006.01) |

(56) References Cited

U.S. PATENT DOCUMENTS

| | | | | |
|---|---|---|---|---|
| 4,212,103 | A | 7/1980 | Schuman-Hoole | |
| 4,310,968 | A | 1/1982 | Buik et al. | |
| 4,562,645 | A | 1/1986 | Dato et al. | |
| 4,998,347 | A | 3/1991 | Schächter | |
| 5,063,667 | A | 11/1991 | Jacobson | |
| 5,313,705 | A | 5/1994 | Rivers et al. | |
| 5,331,740 | A | 7/1994 | Carson, III et al. | |
| 5,359,774 | A | 11/1994 | Althaus | |
| 5,526,567 | A | 6/1996 | Carson, III et al. | |
| 5,537,749 | A | 7/1996 | Cacioppo | |
| 5,590,468 | A | 1/1997 | Prochaska | |
| 5,600,887 | A | 2/1997 | Olson | |
| 5,794,354 | A | 8/1998 | Gilder | |
| 5,802,721 | A * | 9/1998 | Wain et al. | 30/34.2 |
| 6,233,829 | B1 * | 5/2001 | Oglesby et al. | 30/34.2 |
| 6,243,951 | B1 * | 6/2001 | Oldroyd | B26B 21/227 30/34.2 |
| 6,550,141 | B1 | 4/2003 | Rivers et al. | |
| 7,043,840 | B2 | 5/2006 | Walker, Jr. et al. | |
| 2005/0102847 | A1 | 5/2005 | King | |
| 2006/0225286 | A1 | 10/2006 | Tomassetti | |
| 2006/0277759 | A1 | 12/2006 | Follo | |
| 2006/0283025 | A1 | 12/2006 | Follo et al. | |
| 2007/0028449 | A1 | 2/2007 | King | |

FOREIGN PATENT DOCUMENTS

| | | | |
|---|---|---|---|
| GB | 821826 | | 10/1959 |
| GB | 2 081 165 | A | 2/1982 |
| GB | 2 264 888 | A | 9/1993 |
| GB | 2 354 474 | A | 3/2001 |
| WO | WO 92/06827 | | 4/1992 |
| WO | WO 92/20499 | | 11/1992 |
| WO | WO 93/01918 | | 2/1993 |
| WO | WO 96/04111 | A1 | 2/1996 |
| WO | WO 96/24469 | | 8/1996 |
| WO | WO 98/05479 | | 2/1998 |
| WO | WO 99/50034 | | 10/1999 |
| WO | WO 00/30816 | | 6/2000 |
| WO | WO 00/37227 | | 6/2000 |
| WO | WO 2004/069496 | | 8/2004 |
| WO | WO 2006/086314 | A1 | 8/2006 |

* cited by examiner

SHAVING RAZORS AND CARTRIDGES

CROSS REFERENCE TO RELATED APPLICATION

This application claims the benefit of U.S. Provisional Application No. 61/095,840, filed on Sep. 10, 2008.

FIELD OF THE INVENTION

The present invention relates to shaving razors and more particularly to shaving razor cartridges having a housing with improved rinsing characteristics and a guard enabling for the orientation and passage of hair to a blade for efficient and effective shaving.

BACKGROUND OF THE INVENTION

In recent years shaving razors with numerous blades have been proposed in the literature and commercialized, e.g., in U.S. Pat. Pub. 2005/0039337 A1 published on Feb. 24, 2005, which generally describes a type of design that has been commercialized globally as the five bladed Fusion™ razor by The Gillette Company.

In emerging markets, such as China and India, the shaving razor of choice is a standard double edge style razor, e.g., in U.S. Pat. No. 3,274,683 issued Sep. 27, 1966, generally describes a typical design used in emerging markets. Consumers in these markets typically do not have the means to purchase the shaving razors that are widely popular in the United States. The standard double edge style razor may be economical, but the user tends to experience nicks, cuts and irritation.

Shaving consumers in emerging markets typically shave infrequently, sometimes only once or twice a week. There is also little or no availability of running water to rinse or clean a shaving razor and the availability of skin cleansers and pre-shaving and post-shaving shaving aids are limited. Pre-shaving aids may include shaving oils, gels and lotions and post-shaving aids may include after shave gels, lotions and moisturizers. A cup or bowl is typically filled with water and is used to rinse the shaving razor. The shaving razors disclosed in the above mentioned patent application are quite sophisticated having have been designed for Western shaving habits, practices and environments, and thus do not deliver an ideal shaving experience for consumers in emerging markets. The shaving consumer in emerging countries have a much different shaving environment as well as different shaving habits and practices than the typical shaving consumer in more developed countries, such as the United States. Even if a less sophisticated version of the popular five bladed Fusion™ shaving razor was available for these consumers, it would still not provide the optimal shaving experience because of their unique habits, practices and shaving environment.

It is therefore desirable to provide a shaving razor with the increased safety of an improved guard, superior long hair cutting performance and improved rinsing and cleaning capabilities.

SUMMARY OF THE INVENTION

In one aspect, the invention features, in general, a housing having a proximal end portion and a distal end portion. At least one blade having a cutting edge is mounted to the housing with a blade support structure. A guard is at the distal end portion of the housing and has a plurality of projections substantially perpendicular to the blade that define a plurality of slots. A washout cavity beneath the blade is defined by an inner surface of the guard and an inner surface of the blade support structure. The washout cavity has an open area of at least 80 percent for allowing unobstructed passage of water substantially along an entire length of the blade.

In another aspect, the invention features, in general, a shaving razor cartridge having a housing with a proximal end portion, a distal end portion, and a pair of lateral end portions. At least one blade with a cutting edge is mounted to the housing. A guard is at the distal end portion of the housing. The guard has an edge spaced apart from the cutting edge of the blade by about 1.75 mm to about 2.5 mm. The guard has a plurality of spaced apart projections with a proximal end portion extending beyond the edge of the guard and spaced apart from the cutting edge by about 0.4 mm to about 1.0 mm. If desired, particular embodiments may optionally include a handle mounted to the housing.

DETAILED DESCRIPTION OF THE INVENTION

Figure 1:
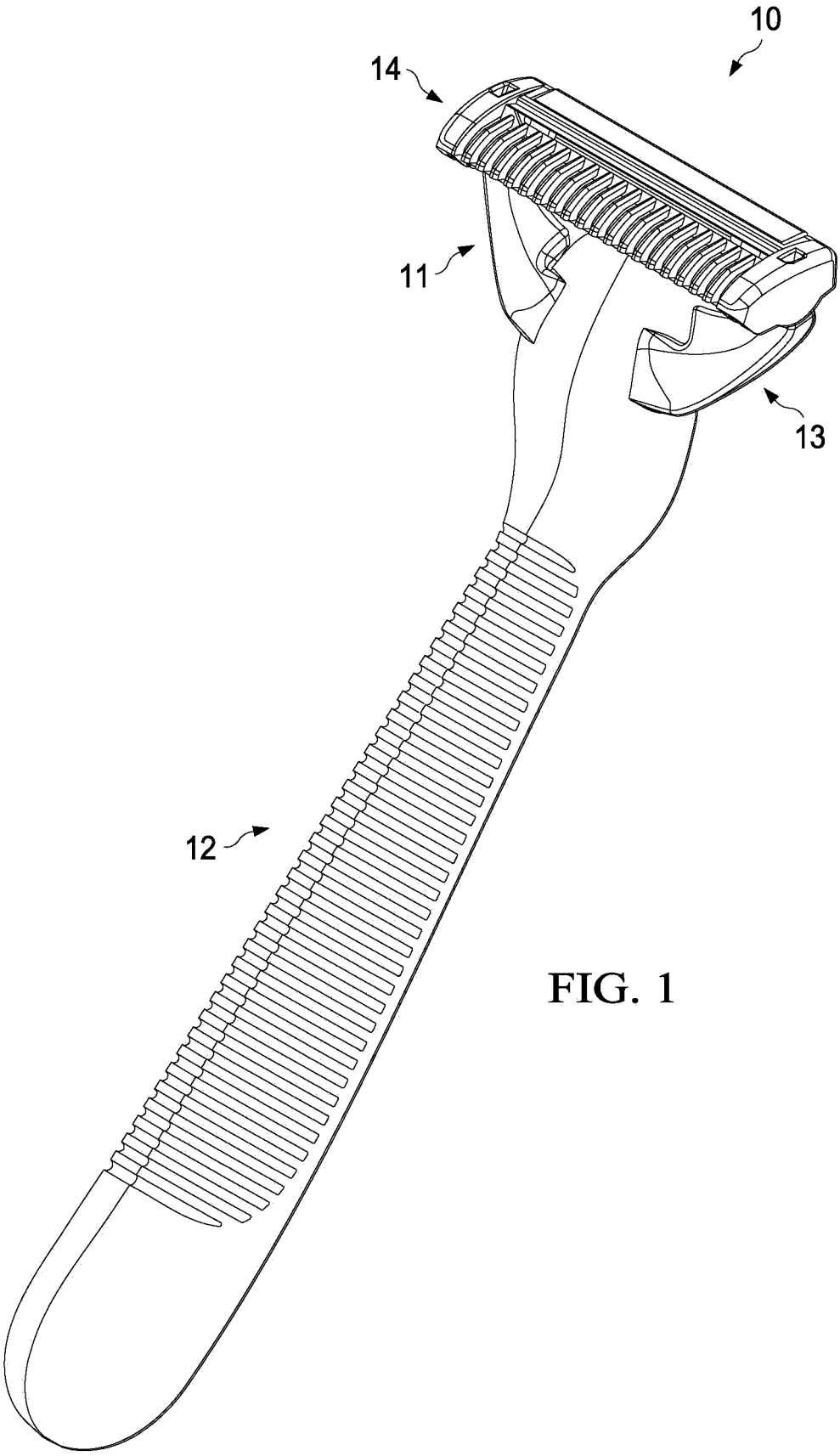
FIG. 1 is a perspective view of a wet shaving razor.

Referring to FIG. 1, one possible embodiment of the present disclosure is shown illustrating a shaving razor 10 having a handle 12 and a shaving cartridge 14. In certain embodiments, the shaving cartridge 14 may be detachably mounted to the handle 12 with a pair of opposing arms 11 and 13. The opposing arms 11 and 13 may allow for an open space or window below the shaving cartridge 14, which may improve the ability for water to enter and rinse out the shaving cartridge 14. The shaving cartridge 14 may be detached from the arms 11 and 13 and replaced with a new shaving cartridge 14 as needed by a user to achieve certain desired shaving characteristics. In other embodiments, the shaving cartridge 14 may be securely fixed to the handle 12, in which the entire shaving razor 10 would be replaced as needed. The opposing arms 11 and 13 may be either rigidly mounted to the shaving cartridge 14 or mounted to the shaving cartridge 14 to allow one or more degrees of movement, such as pivoting relative to the handle 12. Both the detachably mounted shaving cartridge 14 embodiment and securely fixed shaving cartridge 14 embodiment may utilize either a fixed or pivoting shaving cartridge 14. The handle 12 and opposing arms 11 and 13 may be injection molded as a single component (as shown) or may be assembled separately utilizing snap fit designs, insert molding, ultrasonic welding, adhesives or other assembly methods known to those skilled in the art.

Figure 2:
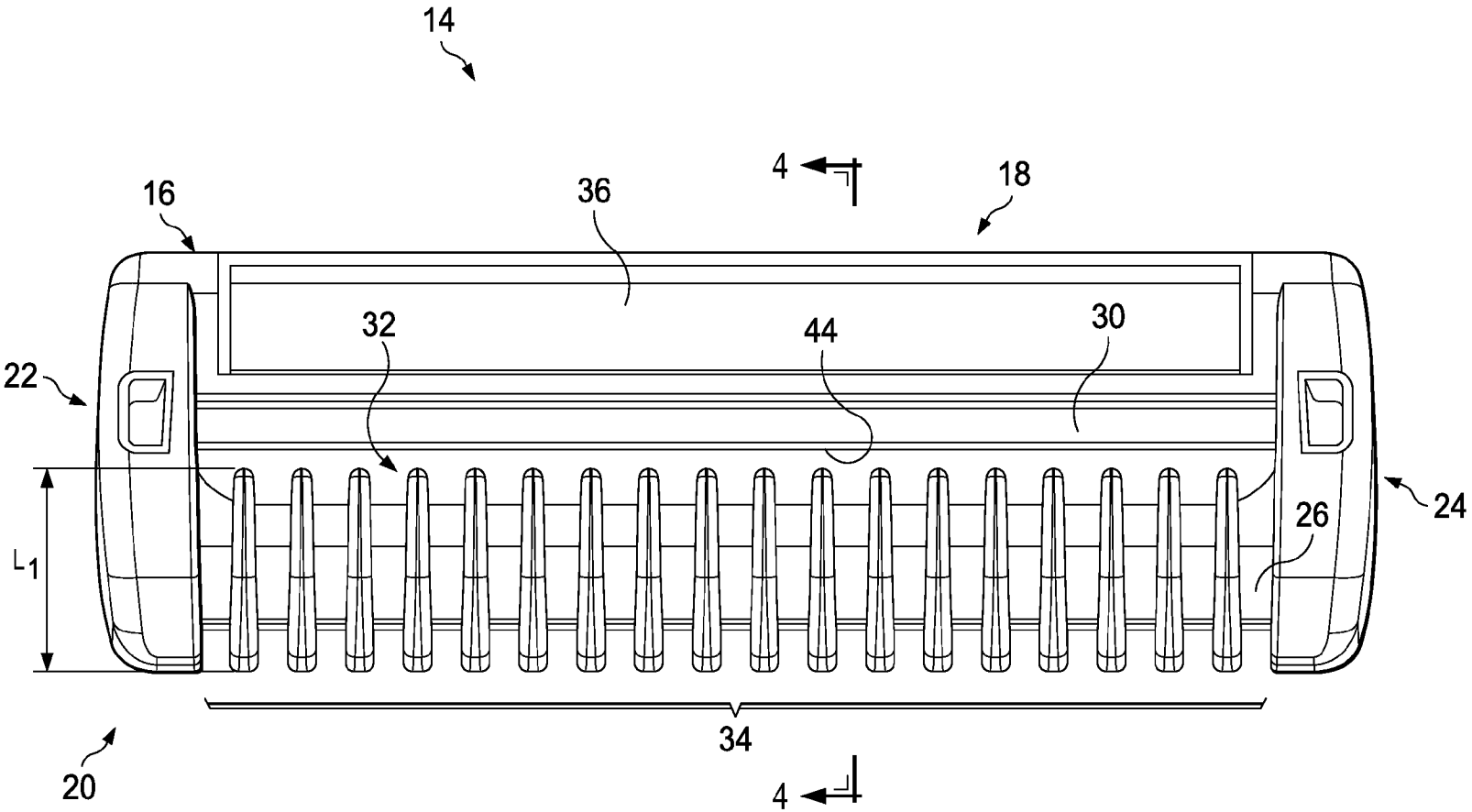
FIG. 2 is a top view of a cartridge which may be incorporated in the shaving razor shown in FIG. 1.

Now turning to FIG. 2, the shaving cartridge 14 may include a housing 16 having a proximal end portion 18, a distal end portion 20, a first lateral end portion 22, and a second lateral end portion 24. The distal end portion 20 may include a guard 26 that extends longitudinally from the first lateral end portion 22 to the second lateral end portion 24. A blade 30 for cutting hairs may be mounted within the housing parallel to the guard 26. The blade 30 may be positioned between the proximal end portion 18 and the guard 26 with an exposure of substantially zero. Even though only a single blade 30 is shown multiple blades 30 may be mounted within the housing 16. The housing 16, the guard 26 and the blade 30 may define a frame or opening 32. As will be described in greater detail below, the frame or opening 32 may allow for improved rinsability of the blade 30 and cartridge 16. The frame or opening 32 may be dimensioned to allow the easy passage of water to and around the blade 30. If the blade 30 and/or cartridge 16 become clogged with trapped hair, debris and/or shaving aids, the blade 30 may not cut the hair as effectively and efficiently. The improved rinsability may result in a cleaner and improved shaving experience due to the quicker and more effective removal of trapped hair, debris and/or shaving aids from the blade 30. The frame or opening 32 may also allow for an increased number of shaving strokes before the cartridge 14 needs to be rinsed, because less hair is trapped around the blade 30.

The guard 26 may include a plurality of projections 34 that are positioned along a substantial length of the guard 26 and extend up to or distally beyond the housing 16 to act as a comb feature to receive and align hairs during shaving. The projections 34 may have a length "L1" and may extend substantially perpendicular to the blade 30. In certain embodiments L1 may be within the range of 3 mm and 10 mm, preferably about 5 mm to about 8 mm. The guard 26 may have between 8 and 25, preferably between 14 and 18, projections 34 along its length that are uniformly spaced apart from each other. As will be described in greater detail below, the guard 26 and the projections 34 may be configured for the management of skin and may aid in guiding hair to the blade 30. The projections 34 and the guard 26 may orient the hair in an upward direction away from the skin surface and present it to the blade 30 to provide for efficient and accurate cutting of the hair. In certain embodiments, the guard 26 and the projection 34 may be configured to guide and lift longer hairs from the skin surface and release the hairs before the hairs contact the blade 30. Long hairs may include hair that has not been shaved for greater than about 72 hours. The shaving razor 10 may also be used to cut hair that has been previously shaved within about 72 hours. The guard 26 may be molded from polymers such as high impact polystyrene (HIPS), but other semi-rigid polymers such as polypropylene (PP) and acrylonitrile butadiene styrene (ABS) may also be used. The guard 26 and projections 34 may be molded from the same or a different polymer than the housing 16.

A lubricating strip 36 may be secured to the proximal end portion 18 of the housing 16 and may extend from the first lateral end portion 22 to the second lateral end portion 24. The lubricating strip 36 may be secured to the proximal end portion 18 of the housing 16 using chemical means such as adhesives or mechanical means such as snap or press fit designs. The lubricating strip 36 may be manufactured from a base polymer such as styrene and contain one or more anti-microbial agents that are applied to the skin during shaving to aid in reducing the possibility of infection, sepsis, or putrefaction. Microbes have the tendency to grow in the presence of water, and thus may grow on the blade 30 or other components of the cartridge 14 while the shaving razor 10 is drying after being used (e.g. during storage). The presence of microbes on the blade 30 or other components of the cartridge 14 may increase the likelihood of infection when the shaving razor 10 is used again. The anti-microbial agents present on or in the lubricating strip 36 may aid in reducing the growth of microbes, such as bacteria or fungi, on the surfaces of the blade(s) 30, housing 16 and other parts of the cartridge 14 while the shaving razor is being stored or not in use. Examples of anti-microbial agents may include, but are not limited to, turmeric, triclocarban, triclosan and chloroxylenol. The anti-microbial agent(s) may include both a natural ingredient anti-microbial agent and a synthetic chemical anti-microbial agent.

Figure 3:
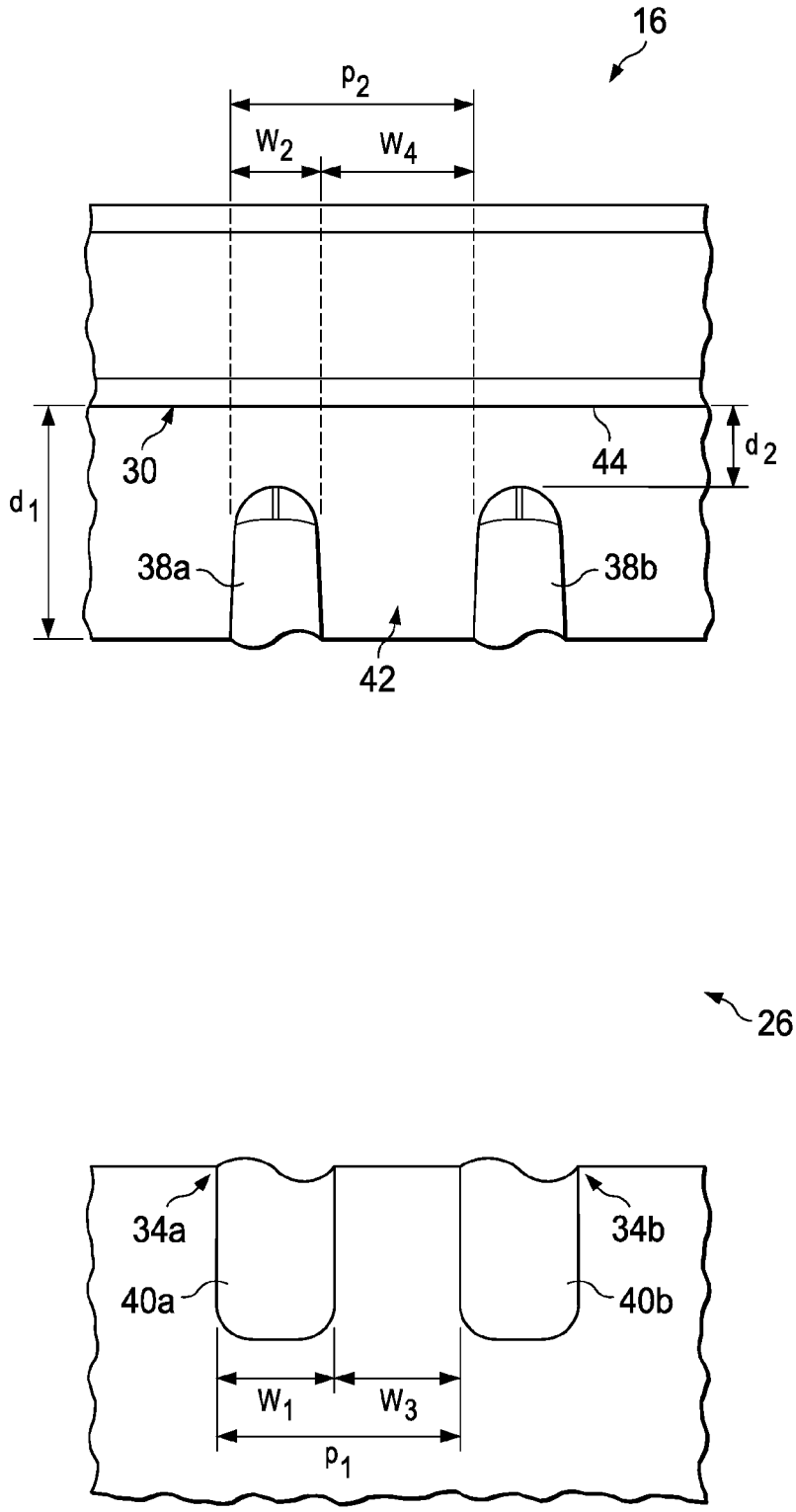
FIG. 3 is an enlarged bottom view of the cartridge shown in FIG. 2.

Referring to FIG. 3, an enlarged bottom side view of the cartridge a detail plan view of the cartridge 16 is shown illustrating two adjacent projections 34*a* and 34*b* that extend from the guard 26 and are substantially perpendicular to the blade 30. The projections 34*a* and 34*b* may each have a proximal end portion 38*a* and 38*b* and a distal end portion 40*a* and 40*b*, respectively. The distal end portions 40*a* and 40*b* may have a first width "$w_1$" and the proximal end portions 38*a* and 38*b* may have a second width "$w_2$". In certain embodiments, the projections 34*a* and 34*b* may taper towards the blade 30 such that $w_1$ is greater than $w_2$. The width $w_1$ may vary depending the desired shaving characteristics, for example, $w_1$ may have a range from about 0.5 mm to about 1.2 mm, preferably about 0.9 mm. The width $w_2$ may also vary depending the desired shaving characteristics, for example, $w_2$ may have a range from about 0.3 mm to about 1.0 mm, preferably about 0.7 mm.

The two adjacent projections 34*a* and 34*b* may have substantially straight side walls defining a through slot 42 between them. The slot 42 may be dimensioned to allow hair to pass through with minimal interference. The slot 42 may have a leading end width "$w_3$" and a trailing end width "$w_4$". In certain embodiments, the leading end width "$w_3$" and the trailing end width "$w_4$" may be substantially equivalent. In other embodiments $w_3$ may be less than $w_4$, which may allow for improved rinsing of the blade 30. The leading end width $w_3$ may also be greater than the trailing end width $w_4$, to help guide hairs along the slot 42 and to the blade 30. The widths $w_3$ and $w_4$ may vary depending the desired shaving characteristics, for example, $w_3$ and $w_4$ may have a range from about 0.7 mm to about 1.5 mm, preferably about 0.9 mm to about 1.2 mm.

The slot 42 may have an angle as created by adjacent projections 34*a* and 34*b*, which may also vary depending the desired shaving characteristics, for example, the taper angle of the slot may have a range from about 1 degree to about 5 degrees. The taper angle of the slot may help guide hairs to the blade 30. The projections 34 may have respective slot pitches that represent the distance the projections 34 are spaced apart from each other. The slot pitch may be measured from a face of one projection 34*a* to a corresponding face of an adjacent projection 34*b*. There may be a leading end slot pitch "$p_1$" and a trailing end slot pitch "$p_2$". The slot pitch "$p_1$" and "$p_2$" may have a range of approximate 1.7 mm to about 2.5 mm, preferably about 2 mm.

The width of a human hair is approximately 0.10 mm. If the width of the slot 42 is less than about 0.10 mm, then the hair may be caught up in the slot 42 and prevent other hairs from properly passing through the slot and to the blade 30. If the width of the slot 42 is too small it may hamper proper rinsing of the slot and blade 30. Shaving aids, hair, dirt and debris may become trapped within the slot 42, guard 26 and around the blade 30, thus decreasing the effectiveness of the blade 30 to cut hair. This may become even more critical for users that shave infrequently. Longer hairs would be more likely to become trapped within the slot 42, guard 26 and around the blade 30. The longer hairs would also be more likely to trap additional hairs, shaving aids, dirt and debris, thus further clogging up slot 42, the guard 26 and the blade 30, making rinsing even more difficult. If the slot 42, guard 26 and the blade 30 are not properly rinsed, the blade 30 will not properly cut the hair, which may result in nicks, cuts, uncut hairs and an inefficient shave that requires more passes of the blade 30 on the user's skin.

As previously discussed, the housing 16, the guard 26 and the blade 30 may define the frame or opening 32 having an open area for water to wash out the blade 30. The frame or opening 32 may allow for improved rins ability of the blade 30 and cartridge 16. The frame or opening 32 may be dimensioned to facilitate a passage of water to and around the blade 30. The frame or opening 32 may have an open area of more than about 75 percent, with a preferable open area of greater than 85 percent. The open area may be defined as the percentage of the frame or opening 32 that is uninterrupted by the guard 26, projections 34 or other components that may hamper rinsing. For example, the frame or opening 32 may have a square area of about 91 mm2 of which approximately 11 mm2 may be interrupted by the plurality of projections 34. In this particular example the frame or opening 32 would have an open area of about 89 percent. In certain embodiments the frame or opening 32 may have a first span or dimension "d1" as defined as the distance from a cutting edge 44 of the guard 26 to an edge 44 of the blade 30. The first dimension d1 may allow for the hair passing through the guard 26 to orient and present the hair to the blade 30 for a clean effective cut. The first dimension d1 may also provide an open and unobstructed area for water to rinse the blade 30 clean. In certain embodiments d1 may have a range from about 1.75 mm to about 2.5 mm, preferably about 2.3 mm. The frame or opening 32 may have a second span or dimension "d2" as defined as the distance from an edge of one of the proximal end portion 38*a* and 38*b* of the projections 34 to the cutting edge 44 of the blade 30. In certain embodiments d2 may have a range from about 4 mm to about 1.0 mm, preferably about 0.6 mm to about 0.8 mm. The second dimension d2 may allow for the hair passing through the guard 26 to stand up straight so it can be properly cut by the blade 30, while also providing an open area for water to rinse the blade 30 clean.

Figure 4:
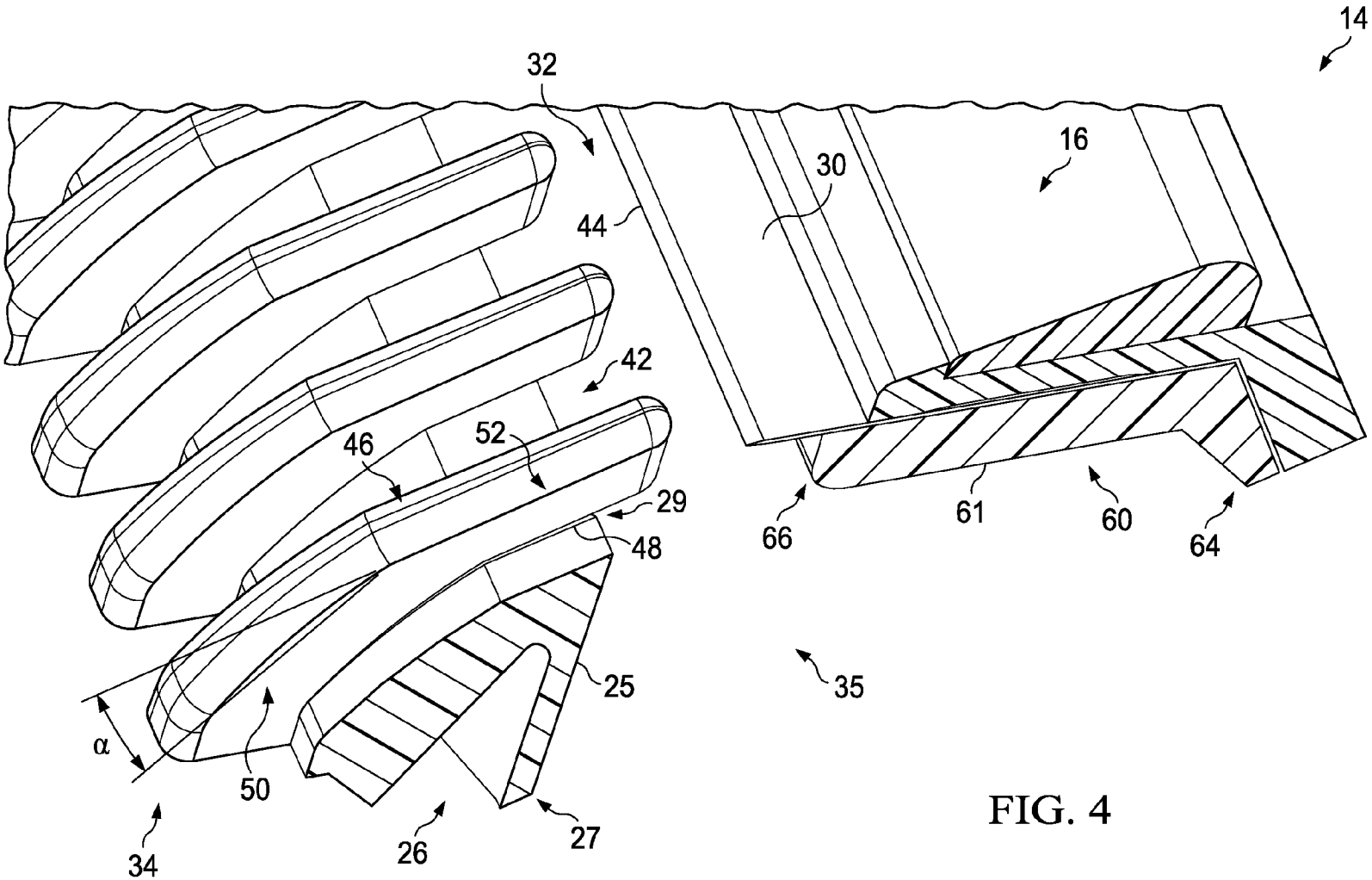
FIG. 4 is an enlarged perspective cross section view, taken generally on the line 4-4, FIG. 2.

Referring now to FIG. 4, an oblique cross section view of the cartridge 14 is shown illustrating the guard 26, projection (s) 34 and blade 30. The projections 34 may have a leading or distal end portion 50 that is offset at an angle $\alpha$ to a trailing or proximal end portion 52, which is adjacent to the blade 30. The leading end portion 50 and the trailing end portion 52 may each have a length of about 1.5 mm to about 4 mm (preferably about 3 mm), between which hair may pass. The angle may have a range of approximately 20 degrees to about 30 degrees. The leading end portion 50 and the trailing end portion 52 of the projection(s) 34 may have a top surface 46 that is configured to contact a user's skin during shaving. In certain embodiments, a substantially flat surface with curved or radius side surfaces may be preferred to increase the contact area with the skin and improve skin management. A radius on the top surface may be used to improve feel to the user as the projections(s) 34 contact the skin during shaving.

The dimensions of the slot 42 near the top surface 46 may be similar to the dimensions measured at a base 48 of the projections or the projections 34 may taper from the top surface 46 to the base 48. The projections 34, for example, may have a taper angle of 1-2 degrees per side. The leading end portion 50 and the trailing end portion 52 of the projection (s) 34 may have a height (which may also be defined as slot 42 depth) as measured from the base 48 of the projections(s) to the top surface 46. The slot 42 depth or projection 34 height may vary along the length of the leading end portion 50 and the trailing end portion 52 within a range of about 0.75 mm to about 2 mm, preferably about 1.0 mm to about 1.5 mm.

The cartridge 14 may include the housing 16, the blade 30 and a blade support structure 60. The blade support structure 60 may be secure to the housing and support the blade 30. The blade 30 may be positioned securely between a bottom surface of the housing 16 and a top surface of the blade support structure 60. The blade support structure 60 may be part of the housing 16 or a separate component mounted to the housing 16. The frame or opening 32 as defined by the housing 16, the guard 26 and the blade 30 may taper or expand out beneath the blade 30 to a washout cavity 35. The washout cavity 35 may extend a substantial length of the blade 30, for example, 80% or more (preferably 95% or more). The washout cavity 35 may be dimensioned to allow the unencumbered and easy passage of water underneath and around the blade 30, for example the washout cavity 35 may have an open area of at least 70% with a preferable open area of more than 85%. Extra components and features located within the washout cavity 35 may reduce the open area and hinder the passage of water underneath and around the blade 30. In certain embodiments there are no components such as members of the housing 16 or guard 26 located within the washout cavity 35. Components of the housing 16 or guard 26 that extend parallel or perpendicular to the blade 30 and are located in the washout cavity 35, decrease the efficiency of rinsing out the blade 30. In certain embodiments an area below the blade 30 may be unobstructed along a substantial portion or the entire cutting length of the blade 30. If the blade 30 and/or housing 16 are clogged with trapped hair, debris and/or shaving aids the blade 30 may not cut the hair as effectively and efficiently. The washout cavity 35 may be defined by an inner surface of the guard 26 and the blade support structure 60.

The inner surface 25 of the guard 26 and the inner surface 61 of the blade support structure 60 may each have a first end portion 29 and 66 (respectively) adjacent the blade 30 that tapers or expands out to a second end portion 27 and 64 located distal of the blade 30. The taper of the inner surfaces 25 and 61 may allow for more water to access and rinse the blade 30. The washout cavity 35 may have a first opening just beneath the blade 30 between the first end portions 29 and 66 of the inner surfaces 25 and 61 of the guard 26 and the blade support structure 60, respectively. The first opening may have a minimum dimension as measured from the first end portion 29 of the inner surface 25 of the guard 26 to the first end portion 66 of the inner surface 61 of the blade support structure 60. In certain embodiments, the first opening may have a minimum dimension of approximately 0.75 mm to about 3.0 mm, preferably about 0.75 mm to about 2.0 mm and more preferably at least about 1.75 mm. The washout cavity 35 may continue to expand or taper outward to a second opening as measured by the distance between the second end portions 27,64 of the inner surfaces 25,61 of the guard 26 and the blade support structure 60, respectively. In certain embodiments, the second opening may have a minimum dimension of approximately 5 mm to about 10 mm, preferably greater than 7.0 mm. The frame or opening 32 and the washout cavity 35 may extend substantially along the entire length of the guard 26.

Figure 5A:
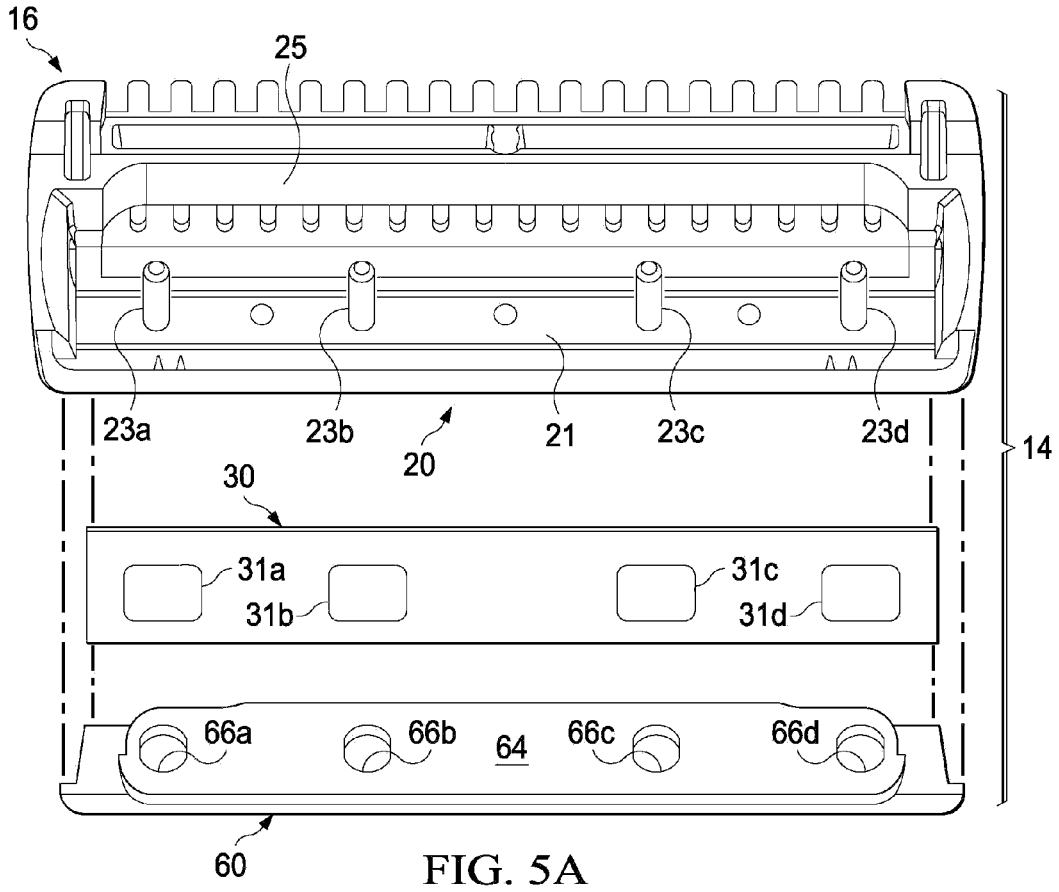
FIG. 5A is an exploded bottom view of the cartridge shown in FIG. 2.

Referring now to FIG. 5A, an exploded bottom side view of cartridge 14 is shown, illustrating the assembly of the cartridge 14. The cartridge 14 may include the housing 16, the blade 30 and the blade support structure 60. The distal end portion 20 of the housing 16 may have a plurality of substantially cylindrical bosses 23*a*, 23*b*, 23*c* and 23*d* extending up and away from a bottom surface 21 of the housing 16. The blade 30 may have a plurality of openings 31*a*, 31*b*, 31*c* and

31*d* that are dimensioned to receive the cylindrical bosses 23*a*, 23*b*, 23*c* and 23*d* of the housing 16. The blade support structure 60 may have a plurality of openings 66*a*, 66*b*, 66*c* and 66*d* that correspond to the cylindrical bosses 23*a*, 23*b*, 23*c* and 23*d* of the housing 16. The plurality of openings 66*a*, 66*b*, 66*c* and 66*d* in the blade cover 64 may be smaller than the plurality of openings 31*a*, 31*b*, 31*c* and 31*d* in the blade 30. The blade 30 may be mounted on the distal end portion 20 of the housing 16 such that the plurality of openings 31*a*, 31*b*, 31*c* and 31*d* of the blade 30 receive a corresponding boss 23*a*, 23*b*, 23*c* and 23*d* of the housing 16. The blade support structure 60 may then be placed over the blade 30 such that the plurality of openings 66*a*, 66*b*, 66*c* and 66*d* of the blade support structure 60 receive a corresponding boss 23*a*, 23*b*, 23*c* and 23*d* of the housing 16.

Figure 5B:
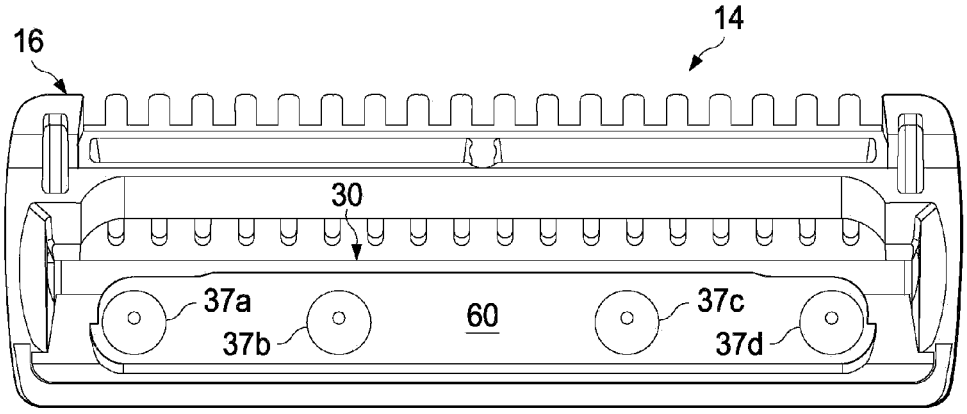
FIG. 5B is a bottom view of the cartridge shown in FIG. 2.

Referring to FIG. 5B a bottom side view of the cartridge 14 is shown with the blade 30 and blade support structure 60 assembled to the housing 16. A plate (not shown) may be used during the assembly process to stamp or press the housing 16, blade 30 and blade support structure 60 together. A cold forming process may be used to crush the bosses (see FIG. 5A) to form attachment discs 37*a*, 37*b*, 37*c* and 37*d* which have a diameter that is sized to cover the openings 66*a*, 66*b*, 66*c* and 66*d* (see FIG. 5A) of the blade support structure 60. The attachment discs 37*a*, 37*b*, 37*c* and 37*d* may secure the blade 30 and the blade support structure 60 to the housing 16. The blade support structure 60 may be injection molded from a polymer such as high impact polystyrene. The blade 30 may be manufactured from stainless steel, titanium or other known blade materials. Other blade assembly methods such as insert molding, snap and press fit designs, hot staking, adhesives and mechanical fasteners may also be used.

Figure 6:
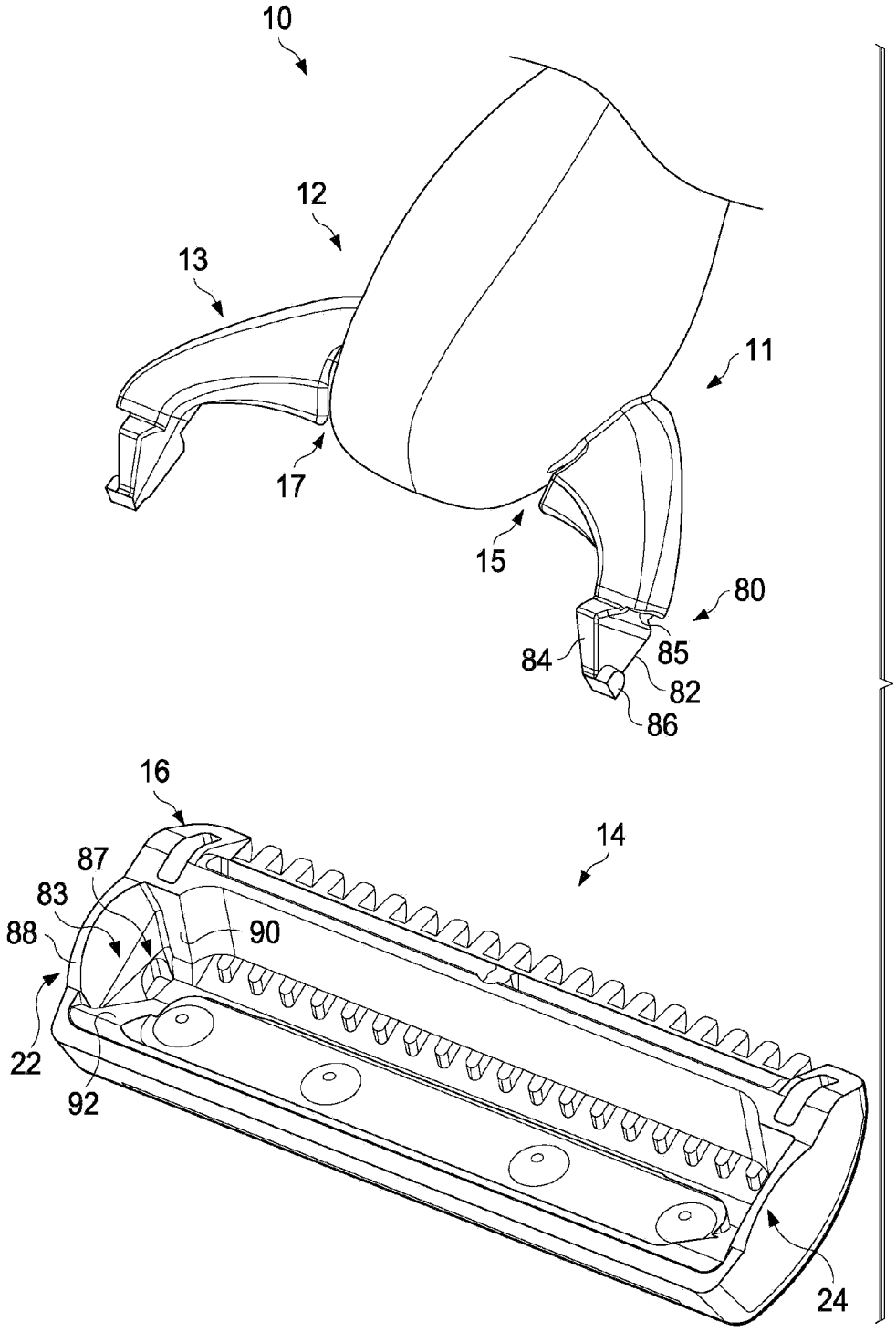
FIG. 6 is an exploded partial view of the shaving razor of FIG. 1.

Referring now to FIG. 6, a detailed exploded view of the wet shaving razor 10 is shown. In certain embodiments, the handle 12 may be securely mounted to the cartridge 14 so the cartridge 14 cannot be removed easily from the handle 12. Permanent joining processes such as insert molding, adhesives and ultrasonic welding may be used to securely mount the cartridge 14 on the handle 12. Semi permanent methods of assemblies such as snap fits, press fits, mechanical fasteners and any combination thereof may also be used to securely mount the cartridge 14 to the handle 12. Semi permanent joining processes may allow for either easy or difficult removal of the cartridge 14 from the housing 16, depending on the desired function. The cartridge 14 may pivot or may have a fixed angle relative to the handle 12 after it is securely mounted to the handle 12.

FIG. 6 illustrates one possible embodiment of the cartridge 14 being securely mounted on the handle such that the cartridge 14 is at a fixed angle relative to the handle 12 after it is securely mounted to the handle 12. The first and second arms 11 and 13 may connect to the first and second lateral end portions 22 and 24, respectively, of the housing 16. The first and second arms 11 and 13 may each have recess 15 and 17 or an area of reduced wall thickness, where the arms 11 and 13 are joined to the handle 12. The recesses 15 and 17 may allow the arms 11 and 13 to flex toward each other to allow for easier assembly of the handle 12 to the cartridge 14. The first and second arms 11 and 13 and the first and second lateral end portions 22 and 24 may be dimensioned such that the cartridge 14 may be easily removed from the handle 12 and replaced. Alternatively, the first and second arms 11 and 13 and the first and second lateral end portions 22 and 24 may be dimensioned such that the cartridge 14 is difficult to remove from the handle and the entire shaving razor 10 must be replaced after a desired number of uses.

It is understood that the first arm 11 may be identical or a mirror image of the second arm 13 such that the features of the first arm 11 may be referred to as complementary features of the second arm 13. For purposes of clarity, only the first arm 11 and the first lateral end portion 22 of the housing 16 will be described in full detail, as it is understood that the second arm 13 and the second lateral end portion 24 have the same features with the same functions as the first arm 11 and the first lateral end portion 22, respectively.

The first arm 11 may have a first distal end portion 80 having a first knob 86 and a first pair of opposing tapered sidewalls 82 and 84. The first arm 11 and the first distal end portion 80 may form a first shoulder 85 having a substantially arcuate surface. The first lateral end portion 22 may have a first arcuate mating surface 88 and a first recess 83 that is dimensioned to receive the first distal end portion 80 of the first arm 11. The first shoulder 85 of the first arm 11 may rest or contact the first arcuate mating surface 88 of the first lateral end portion 22 of the housing 16. The first recess 83 may be defined by a first pair of tapered opposing walls 90 and 92 that are configured to contact the first pair of opposing tapered sidewalls 82 and 84 of the first arm 11. The first pair of tapered opposing walls 90 and 92 of the housing may act as a stop to prevent pivoting of the cartridge 14 relative to the handle 12. The first pair of tapered opposing walls 90 and 92 may also fix an angle or position of the cartridge 14 relative to the handle 12. The first pair of opposing tapered sidewalls 82 and 84 and the first pair of tapered opposing walls 90 and 92 may be dimensioned to form a tapered interlock with each other to aid in preventing disassembly of the cartridge 14 from the handle 12. The first lateral end portion 22 of the housing may have a first depression 87 that is dimensioned to receive the first knob 86 of the first distal end portion 80 of the first arm 11. The first knob 86 may snap into the first depression 87 of the housing 16 and may aid in preventing disassembly of the cartridge 14.

Figure 7:
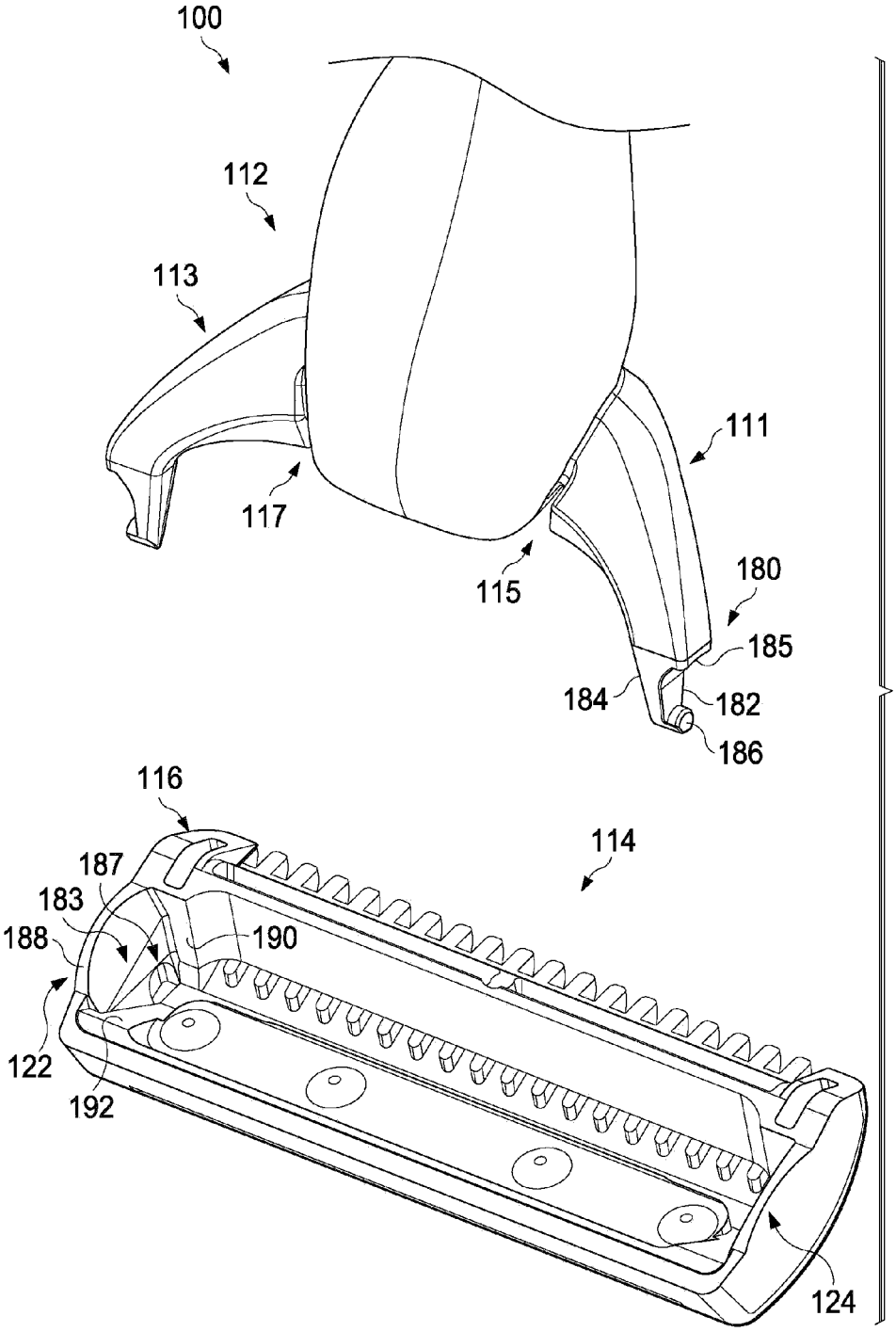
FIG. 7 is an exploded partial view of another possible embodiment of a wet shaving razor.

Referring now to FIG. 7, a detailed exploded view of another possible embodiment of a wet shaving razor 100 is shown. FIG. 7 illustrates a cartridge 114 being securely mounted to a handle 112 such that the cartridge 114 is able to pivot relative to the handle 112 after the cartridge 114 has been securely mounted to the handle 112. It should be understood that the cartridge 114 may be the same or similar to the cartridge 14 as previously detailed. The only difference between the cartridge 14 shown in FIGS. 1-6 and the cartridge shown in FIG. 7 may be the assembly of the cartridge 114 to the handle 112, as will be explained in detail below.

The cartridge 114 may include a housing 116 having first and second lateral end portions 122 and 124. The handle 112 may be joined to a first and second arms 111 and 113 that may connect to the first and second lateral end portions 122 and 124, respectively. The first and second arms 111 and 113 may each have recess 115 and 117, or an area of reduced wall thickness, where they are joined to the handle 112. The recesses 115 and 117 may allow the arms 111 and 113 to flex toward each other to allow for easier assembly of the handle 112 to the cartridge 114. The first and second arms 111 and 113 and the first and second lateral end portions 122 and 124 may be dimensioned such that the cartridge 114 may be easily removed from the handle 112 and replaced. Alternatively, the first and second arms 111 and 113 and the first and second lateral end portions 122 and 124 may be dimensioned such that the cartridge is difficult to remove from the handle and the entire shaving razor 100 must be replaced.

It is understood that the first arm 111 may be identical or a mirror image of the second arm 113 such that the features of the first arm 111 may be referred to as complementary features of the second arm 113. For purposes of clarity, only the first arm 111 and the first lateral end portion 122 will be described in full detail, as it is understood that the second arm 113 and the second lateral end portion 124 have the same features with the same functions as the first arm 111 and the first lateral end portion 122, respectively.

The first arm 111 may have a first distal end portion 180 having a first knob 186 and a first pair of opposing tapered sidewalls 182 and 184. The first arm 111 and the first distal end portion 180 may form a first shoulder 185 having a substantially arcuate bearing surface. The first lateral end portion 122 may have a first arcuate mating surface 188 and a first recess 183 that is dimensioned to receive the first distal end portion 180 of the first arm 111. The first shoulder 185 of the first arm 111 may rest or contact the first arcuate mating surface 188 of the first lateral end portion 122 of the housing 116. The first recess 183 may be defined by a first pair of tapered opposing walls 190 and 192 that are configured to receive the first pair of opposing tapered sidewalls 182 and 184 of the first arm 111. The first lateral end portion 122 of the housing may have a first depression 187 that is dimensioned to receive the first knob 186 of the first distal end portion 180 of the first arm 111. The first knob 186 may snap into the first depression 187 and may aid in preventing disassembly of the cartridge 114 from the handle 112. The first knob 186 and the first depression 187 may be dimensioned to allow the first knob 186 to rotate or pivot within the first depression 187. The first pair of tapered opposing walls 190 and 192 of the housing 116 may act as a stop to limit pivoting of the cartridge 114 relative to the handle 112. The first pair of tapered opposing walls 190 and 192 may limit the total pivoting motion of the cartridge to approximately zero to 90 degrees, preferably about 20 to about 60 degrees and more preferably about 35 to 55 degrees. The first pair of tapered opposing walls 190 and 192 may be adjusted to allow more or less pivoting as needed.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor cartridge comprising:

a housing having a proximal end portion, a distal end portion, and a pair of lateral end portions;

at least one blade mounted to the housing, the blade having a cutting edge;

a guard at the distal end portion of the housing, wherein the housing, the guard and the blade together define an open area of an opening for water to wash out the blade, the guard and the blade being on opposite sides of the open area; and a plurality of spaced apart projections, each projection having a proximal end portion extending across an edge of the guard and into the open area beyond the edge of the guard in a direction toward the proximal end portion of the housing, a slot disposed between adjacent ones of the spaced apart projections, each slot having a trailing end width disposed closest to the blade and between the respective proximal end portions of the projections, wherein the trailing end width is greater than a leading end width of the slot, and wherein the trailing end width is about 0.7 mm to about 1.2 mm facilitating passage of hair with minimal interference.

2. The shaving razor cartridge of claim 1 wherein the projections each further have a distal end portion, and the proximal end portion of each projection is offset from its distal end portion by about 20 degrees to about 30 degrees.

3. The wet shaving razor cartridge of claim 1 wherein the projections are generally perpendicular to the blade.

4. The wet shaving razor cartridge of claim 1 further comprising a blade support structure, wherein the blade is secured between the housing and the blade support structure.

5. The wet shaving razor of claim 4 wherein the guard has an inner surface with a guard end portion proximate the blade and the blade support structure has an inner surface with a blade support end portion proximate the blade, wherein said guard end portion and the blade support end portion are spaced apart from each other by at least 0.75 mm.

6. The wet shaving razor cartridge of claim 5 wherein the inner surfaces of the guard and the blade support structure are tapered.

7. The wet shaving razor cartridge of claim 1 wherein a lubricating strip is secured to the proximal end portion of the housing.

8. The shaving razor of claim 1 further comprising a first span between the edge of the guard and the cutting edge of about 1.75 mm to about 2.5 mm.

9. The shaving razor of claim 1 wherein the projections each have a slot depth from a base of the projection to a top surface of the projection of about 0.75 mm to about 1.5 mm.

10. The shaving razor of claim 1 wherein the slot has a taper angle of about 1 degree to about 5 degrees.

* * * * *